US010056683B2

(12) United States Patent
Sharawi et al.

(10) Patent No.: US 10,056,683 B2
(45) Date of Patent: Aug. 21, 2018

(54) DIELECTRIC RESONATOR ANTENNA ARRAY SYSTEM

(71) Applicant: King Fahd University of Petroleum and Minerals, Dhahran (SA)

(72) Inventors: Mohammad S. Sharawi, Dhahran (SA); Ali Tawfiq Alreshaid, Dhahran (SA); Mohamed Tammam Hussein, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 218 days.

(21) Appl. No.: 14/931,327

(22) Filed: Nov. 3, 2015

(65) Prior Publication Data

US 2017/0125901 A1 May 4, 2017

(51) Int. Cl.

| | |
|---|---|
| ***H01Q 3/24*** | (2006.01) |
| ***H01Q 21/22*** | (2006.01) |
| ***H01Q 9/04*** | (2006.01) |

(52) U.S. Cl.

CPC ..... *H01Q 3/24* (2013.01); *H01Q 9/0485* (2013.01); *H01Q 21/22* (2013.01)

(58) Field of Classification Search

CPC ..... H01Q 3/24

USPC ..... 343/824

See application file for complete search history.

(56) References Cited

U.S. PATENT DOCUMENTS

| | | | | |
|---|---|---|---|---|
| 7,071,879 | B2 | 7/2006 | Strickland | |
| 7,683,841 | B2 * | 3/2010 | Mitsui | H01Q 1/2275 343/702 |
| 2008/0042903 | A1 * | 2/2008 | Cheng | H01Q 9/0485 343/700 MS |
| 2010/0238067 | A1 * | 9/2010 | Nakabayashi | H01Q 13/206 342/70 |

FOREIGN PATENT DOCUMENTS

| | | | | |
|---|---|---|---|---|
| EP | 1 266 428 | B1 | 10/2004 | |
| EP | 1266428 | B1 * | 10/2004 | H01Q 3/24 |
| WO | WO 2012/081958 | A1 | 6/2012 | |

OTHER PUBLICATIONS

Anachoic Chamber reference: https://en.wikipedia.org/wiki/Anechoic_chamber[Jun. 29, 2017 2:30:33 PM] included.*

(Continued)

*Primary Examiner* — Dameon E Levi
*Assistant Examiner* — Walter Davis
(74) *Attorney, Agent, or Firm* — Oblon, McClelland, Maier & Neustadt, L.L.P.

(57) ABSTRACT

A dielectric resonator antenna array system includes a first array of a plurality of dielectric resonator antennas arranged in a first orientation and that forms a first beam, and a second array of a plurality of dielectric resonator antennas arranged in a second orientation, that is different from the first orientation, and that forms a second beam. Further, a dielectric resonator antenna array system includes a first array of a first type of plurality of dielectric resonator antennas arranged in a predetermined orientation and that forms a first beam, and a second array of a second type of plurality of dielectric resonator antennas arranged in the predetermined orientation and that forms a second beam.

17 Claims, 9 Drawing Sheets

(56) References Cited

OTHER PUBLICATIONS

Anechoic Chamber reference: https://en.wikipedia.org/wiki/Anechoic_chamber[Jun. 29, 2017 2:30:33 PM] included.*
Asmaa H. Majeed, et al., "MIMO Antenna Array Using Cylindrical Dielectric Resonator for Wide Band Communications Applications", International Journal of Electromagnetics and Applications, vol. 4, No. 2, 2014, pp. 40-48.
Affan A. Baba, et al., "Aperture and Mutual Coupled Cylindrical Dielectric Resonator Antenna Array", Progress in Electromagnetics Research C, vol. 37, 2013, pp. 223-233.
Chow KY, et al., "Cylindrical Dielectric Resonator Antenna-Array", ISI, Electronics Letters, http://serials.unibo.it/cgi-ser/start/en/spogli/df-s.tcl?prog_art=3096462&language=ENGLISH &view=articoli, vol. 31, Issue 18, 1995, 2 pages (Abstract only).

* cited by examiner

DIELECTRIC RESONATOR ANTENNA ARRAY SYSTEM

BACKGROUND

Millimeter wave technology is to be widely used in future high data rate wireless terminals and devices to achieve the anticipated increase of, for example, 1000× in data throughput in the near future. The frequency spectrum at millimeter waves (i.e. 30 GHz to 90 GHz) has several locations where several Giga Hertz of bandwidth are available for use of wireless commercial communications. Millimeter wave antennas are required for such technology.

The dielectric resonator antennas (DRA) have very attractive features such as the ability to operate at wide range of frequencies. They have high radiation efficiency for low loss dielectrics because the size of the dielectric fills the radian sphere and there are no conduction losses. Thus, DRAs support very small sizes at microwaves and millimeter waves as their size is proportional to the operating wavelength divided by the root of the dielectric material constant. This makes DRAs easy to integrate with other electronic components on a common substrate.

The need for broadband multiple-input-multiple-output (MIMO) antenna systems for 4G and 5G wireless standards is on the rise. More structures that support current and future standards are needed to provide the required high data throughput and multi-standard coverage. Short range communication standards are considering millimeter-wave bands for ultra-high throughput over short distances to allow seamless transfer of multimedia and video streams. Such bands include, but are not limited to, 30 GHz and 48 GHz. The integration of MIMO technology along with millimeter-wave bands will provide a noticeable boost to short range wireless data transfers. The 30 GHz millimeter-wave range is anticipated to have at least two 500 MHz channels or a shared 1 GHz channel. Thus, very large bandwidth can be made available and higher channel capacity values can be anticipated. The use of MIMO will give the data link a huge boost on top of the increased bandwidth.

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

SUMMARY

The present disclosure is related to the field of DRA based millimeter-wave wireless communication systems, as well as multiple-input-multiple-output (MIMO) antenna systems, for mobile wireless terminals and access points. For example, devices such as phones, laptops, tablets etc. can be configured to include the DRA based antenna system that is described in further detail below.

The present disclosure describes DRA based antenna arrays (linear and planar) for millimeter-wave frequencies for consumer electronic devices and short range communications that operate at a center frequency of 30 GHz and above and that provide an operating bandwidth of 1 GHz. The antenna array includes DRA elements (i.e. cylindrical, rectangular, or any other shape that would be recognized by one of ordinary skill in the art). The feed network for these arrays are also illustrated as part of an integrated design of the DRA based antenna system that is capable of tilting a beam via feed network phase excitation. Multiple arrays can be integrated on the sides of mobile device backplanes to provide MIMO capability using various configurations provided for higher throughput short range millimeter-wave communications. The small size of the described DRA based MIMO antenna system advantageously makes them a viable feature for 5G mobile terminals that can provide more than 1 GHz of dedicated bandwidth.

In an exemplary aspect, a dielectric antenna array system includes a first array of a plurality of dielectric resonator antennas arranged in a first orientation and configured to form a first beam, and a second array of a plurality of dielectric resonator antennas arranged in a second orientation, different from the first orientation, and configured to form a second beam.

In an exemplary aspect, a dielectric resonator antenna array system includes a first array of a first type of plurality of dielectric resonator antennas arranged in a predetermined orientation and configured to form a first beam, and a second array of a second type of plurality of dielectric resonator antennas arranged in the predetermined orientation and configured to form a second beam.

In an exemplary aspect, a dielectric resonator antenna array system includes a first array of a plurality of dielectric resonator antennas arranged in a first orientation and configured to form a first beam, a second array of a plurality of dielectric resonator antennas arranged in a second orientation, different from the first orientation, and configured to form a second beam, a first feed network configured to provide a first signal to the first array of the plurality of dielectric resonator antennas to form the first beam, and a second feed network configured to provide a second signal to the second array of the plurality of dielectric resonator antennas to form the second beam.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

The foregoing paragraphs have been provided by way of general introduction, and are not intended to limit the scope of the following claims. The described implementations, together with further advantages, will be best understood by reference to the following detailed description taken in conjunction with the accompanying drawings.

Dielectric resonator antennas (DRA) can take several shapes, but the most common ones are hemispherical, cylindrical, circular cross-sections, and rectangular. The height, length and width (or radius) of the DRAs along with its material properties (i.e. the dielectric constant) determines its resonant frequency, efficiency, bandwidth, and gain along with its radiation pattern. Most of the DRAs are fabricated over a ground metallic sheet, and thus they have directional radiation patterns (such as patches).

Figure 1A:
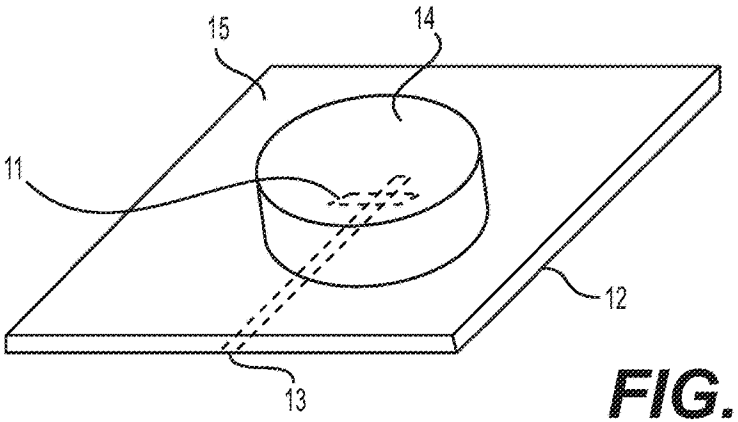
FIGS. 1A and 1B illustrate DRA elements being formed on a ground plane or a dielectric substrate in accordance with exemplary aspects of the present disclosure.

FIG. 1A illustrates an exemplary cylindrical DRA 14 that is placed on a metallic ground plane 15, which is formed on top a dielectric substrate 12. The dielectric substrate 12 can be formed of a material different from the DRA 14 or similar to it. The cylindrical DRA 14 is fed/excited via a microstrip line 13 that couples the energy to the cylindrical DRA 14 via a slot 11 in the ground plane 15. This single DRA element 14 can be then replicated to form linear or planar DRA based arrays. The microstrip line 13 is formed on the dielectric substrate 12 (or in between the dielectric substrate 13 and the ground plane 15), and accordingly the microstrip line 13 is illustrated as a broken line in FIG. 1A. Although FIG. 1A illustrates a cylindrical DRA 14, one of ordinary skill in the art would recognize that any other type of DRA (i.e., for example, hemispherical, circular cross-sections, or rectangular DRA) may be formed on the ground plane 15.

Figure 1B:
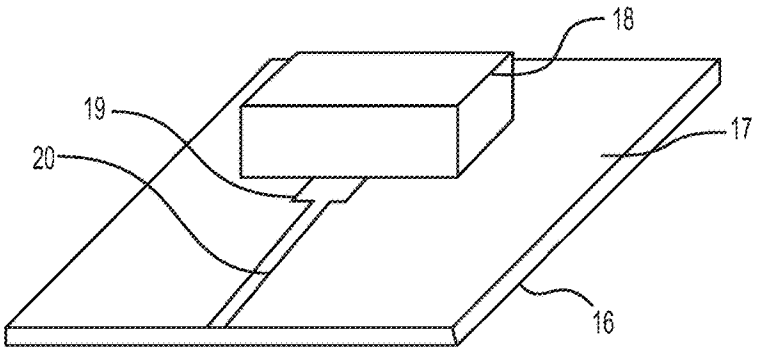

FIG. 1B illustrates another exemplary DRA, which is a rectangular shaped DRA 18, and which is placed on a dielectric substrate 17. Although FIG. 1B illustrates a rectangular DRA 18, one of ordinary skill would recognize that any other type of DRA (i.e., for example, hemispherical, circular cross-sections, or cylindrical DRA) may be formed on the dielectric substrate 17. A metallic sheet 16 (i.e., ground plane) is formed at an opposite end (bottom) of the dielectric substrate 17. The rectangular DRA 18 is fed by a microstrip transmission line 20 via an impedance transformer for impedance matching 19 between an impedance of the transmission line 20 and an impedance of the rectangular DRA 18. The three dimensions of the rectangular DRA 18 (its width, length, and height) determine its resonance frequency and operating bandwidth (its quality factor). The smaller the DRA, the higher the frequencies it can transmit and/or receive. Similarly, the dimensions of cylindrical DRA, circular cross-section DRA, or a hemispherical DRA will determine its resonance frequency and operating bandwidth. For example, different values of the radius and height of a cylindrical DRA provide different resonance frequencies and operating bandwidths of the cylindrical DRA. Further, adjusting a radius of a hemispherical DRA results in different resonance frequencies and operating bandwidths of the hemispherical DRA. Although only a few shapes have been described above, other shapes can be used for a DRA without departing from the scope of the present disclosure.

Figure 2:
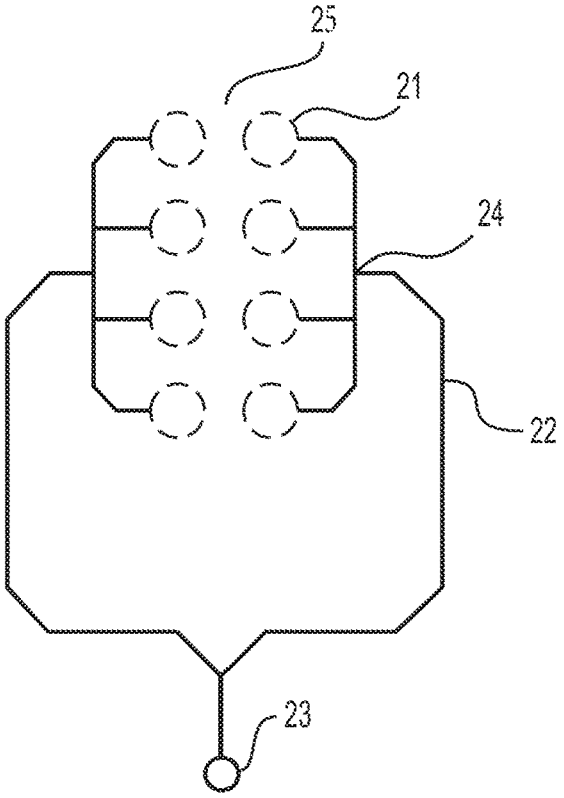
FIG. 2 illustrates a planar DRA based array that includes a plurality of DRA elements in accordance with exemplary aspects of the present disclosure.

FIG. 2 illustrates an exemplary 2×4 planar DRA based array 25 that includes a plurality of cylindrical DRAs 21 fed, or excited, by a corporate feed type of microstrip network 22 that sums the signals (or splits them) from the various cylindrical DRAs 21 and passes them to a single input/output port 23. For instance, if an external signal is received from an external source (not shown), the external signal can be sent to the cylindrical DRAs 21 via the microstrip network 22.

The planar array illustrated in FIG. 2 will have higher gain than a non-planar array and more directivity with narrow half power beam width that is required for short range millimeter-wave communication links. This type of planar array can generate one fixed beam (not shown). The size and shape of the fixed beam can be altered based on the dimensions of the cylindrical DRAs 21. Additionally, the size and shape of the fixed beam can be altered based on spacing between the different cylindrical DRAs 21.

Further, altering the progressive phases between branches 24 can move the beam towards various directions. The microstrip network 22 may incorporate a phase control device (not shown) that can alter the progressive phases between the cylindrical DRAs 21 and the input/output port 23 so that the beam can be moved in various directions in space. In other words, by feeding the cylindrical DRAs 21 with different phases, or with different time delays, the beam can be moved in various directions in space. Alternatively, the phases between the branches 24 may be fixed so that a fixed beam is always formed in a particular direction in space. Although cylindrical DRAs 21 are illustrated in FIG. 2, one or ordinary skill would recognize that any other type of DRA (i.e., for example, hemispherical, circular cross-sections, or rectangular DRA) can be implemented to form a fixed beam.

Figure 3:
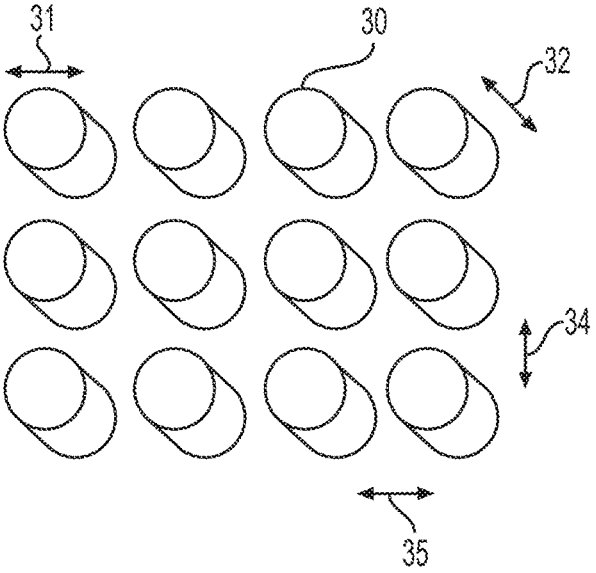
FIG. 3 illustrates a planar antenna array highlighting the dimensions of the DRA elements and the spacing between the DRA elements in accordance with exemplary aspects of the present disclosure.

FIG. 3 illustrates an exemplary 4×3 cylindrical planar antenna array (rectangular hemispherical, or circular cross-section DRAs can also be formed in the same way) highlighting the height 32 of the single DRA 30, diameter 31 of the single DRA 30, and the inter-element spacing in the x-direction 35 and the y-direction 34 between the various DRAs 30. As noted above, the dimensions of a cylindrical DRA, a circular cross-section DRA, a rectangular DRA, or a hemispherical DRA will determine its resonance frequency and operating bandwidth. For example, different values of the length, height, and width of a rectangular DRA and different values of the radius and height of a cylindrical DRA provide different resonance frequencies and operating bandwidths. Further, adjusting a radius of a hemispherical DRA results in different resonance frequencies and operating bandwidths. Although only a few shapes have been described above, other shapes can be used for a DRA without departing from the scope of the present disclosure. The size of the DRA is inversely proportional to the square root of the dielectric constant. Therefore, the higher the dielectric constant of the material, the smaller the DRA. Similarly, the size of the DRA is inversely proportional to the square root of the resonance frequency.

Figure 4:
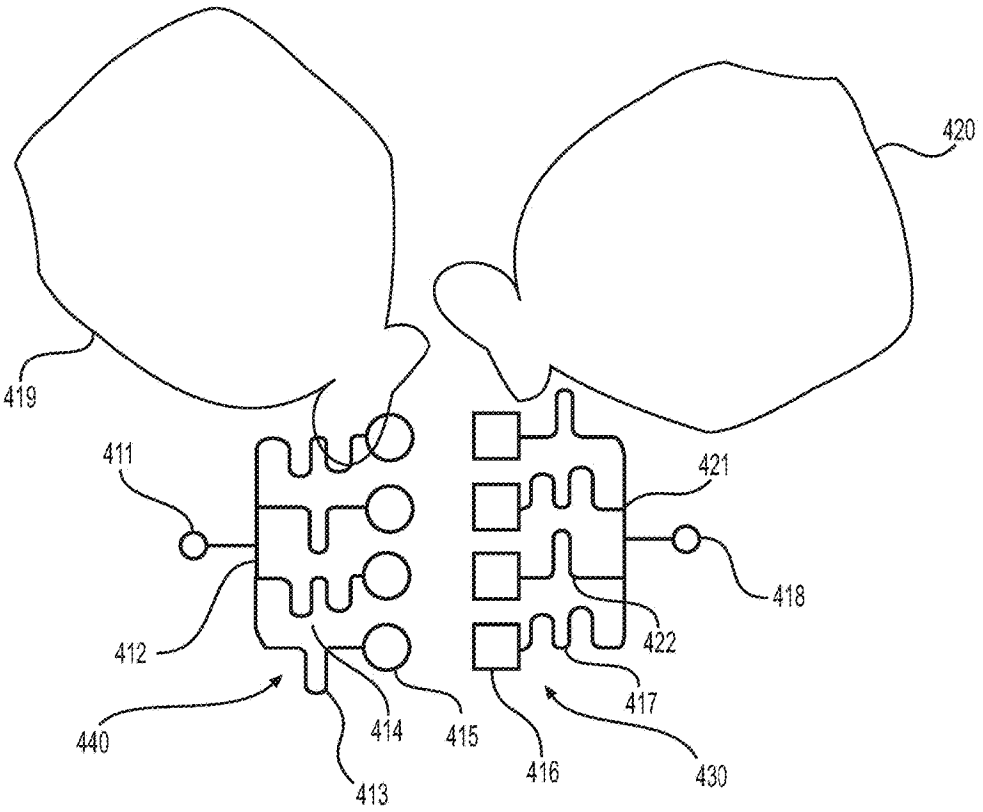
FIG. 4 illustrates a fixed beam MIMO antenna system configuration in accordance with exemplary aspects of the present disclosure.

FIG. 4 illustrates an exemplary fixed beam MIMO antenna system configuration, where similar DRA based arrays (for example, cylindrical-cylindrical or rectangular-rectangular) or opposite DRA based arrays (for example, cylindrical-rectangular) can be used to form two fixed beams 419 and 420 that are tilted from one another to provide a low correlation coefficient.

For example, a first millimeter-wave based fixed beam linear array 430 includes rectangular DRA elements 416 placed in a horizontal or vertical fashion, a feed network with fixed progressive phases 417 and 422, a combiner (or splitter) structure 421, and a dedicated input/output port 418. A second millimeter-wave based fixed beam linear array 440 includes cylindrical DRA elements 415, another fixed phase microstrip feed network with pre-calculated phases 413 and 414 and a combiner (or splitter) structure 412, and a dedicated input/output port 411. Although the fixed beam linear array 430 is illustrated to include rectangular DRA elements, it should be understood that the DRA elements 416 may include any combination of different types of DRA elements (i.e., cylindrical, rectangular, circular cross-section, or hemispherical). Similarly, DRA elements 415 may include any combination of different types of DRA elements (i.e., cylindrical, rectangular, circular cross-section, or hemispherical).

Further, although FIG. 4 illustrates fixed progressive phases 417 and 422, one of ordinary skill would recognize that the progressive phases can be varied in order to vary the direction of a beam. FIG. 4 also illustrates progressive phase 422 corresponding to two out of the four DRA elements 416 and progressive phase 417 corresponding to the other two out of the four DRA elements 416. However, the progressive phases can be altered such that different DRA elements 416 have different phases or same phases. Similarly, pre-calculated phases 413 and 414 can also be varied in order to vary the direction of a beam. Also, the distances between the DRA elements 416 (and between DRA elements 415) can be altered to vary the direction of the fixed beam. The progressive phases can be altered using external phase shifters (not illustrated).

Although FIG. 4 illustrates only two linear based millimeter-wave based arrays, one or ordinary skill would recognize that multiple different linear based millimeter-wave based arrays can be designed with their patterns focusing on various points in space to minimize field correlations. This will enhance device (which includes the DRA based antenna system described herein) capabilities to have better signal transmission/reception and provide higher system capacity.

Figure 5:
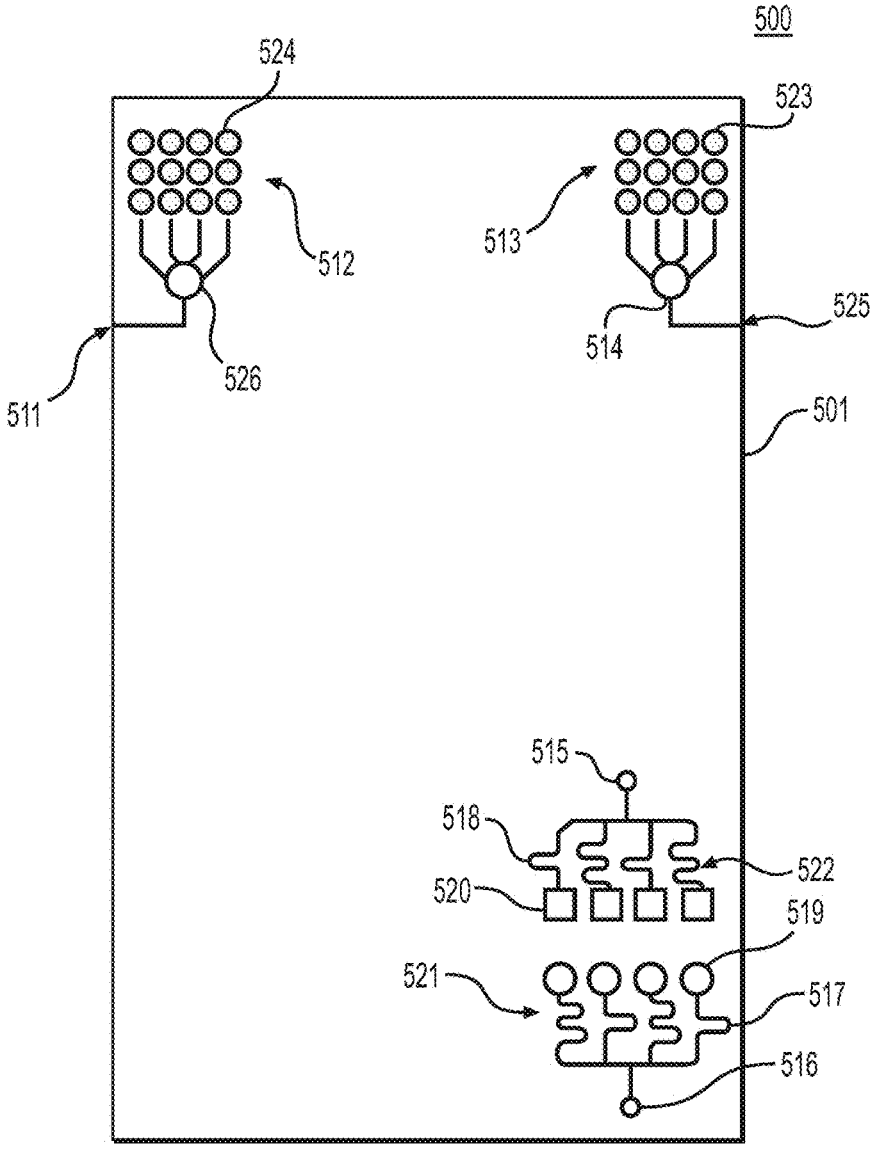
FIG. 5 illustrates a combination of planar based and linear based millimeter-wave DRA MIMO antenna system in accordance with exemplary aspects of the present disclosure.

FIG. 5 illustrates an exemplary combination of planar based arrays 512 and 513 as well as linear based arrays 521 and 522 in the millimeter-wave DRA MIMO antenna system 500. The planar based millimeter-wave DRA fixed beam array 512 includes a planar DRA antenna matrix with DRA elements 524, a microstrip feed network 526 with fixed phases along with its combining (or splitting) network, and a dedicated input/output port 511. The planar based millimeter-wave DRA fixed beam array 513 includes a planar DRA antenna matrix with DRA elements 523, a microstrip feed network 514 with fixed phases along with its combining (or splitting) network, and a dedicated input/output port 525. These array configurations along with their fixed beams can be replicated on a device to provide multiple focused beams in different directions in space. The DRA elements 523 and 524 in the planar based millimeter-wave DRA fixed beam array 513 and planar based millimeter-wave DRA fixed beam array 512, respectively, can include any combination of different types of DRA elements (i.e., cylindrical, rectangular, circular cross-sections, or hemispherical).

The linear array based millimeter-wave DRA MIMO antenna system (including linear DRA arrays 521 and 522) can have similar or different DRA elements in each configuration. The linear DRA arrays 521 and 522 can be closely packed with different phases (517 or 518) within their feeding networks. Each linear DRA 521 and 522 array has its dedicated input/output port 516 and 515, respectively (since this is a MIMO antenna configuration, each linear or planar DRA array acts as if it was a single element), a specific feed network with progressive phases 517 (or 518), that will tilt the beam towards different angles to minimize the correlation coefficient and the correlation between DRA elements 519 (or 520) themselves. Distances between linear DRA arrays or planar DRA arrays can be fixed to half of a wavelength. However, since the setup of different arrays is different, the distance between linear DRA arrays or planar DRA arrays can be altered to different values.

Further FIG. 5 illustrates the planar DRA arrays 512 and 513 and the linear DRA arrays 521 and 522 formed on a metallic ground plane 501. Although the planar DRA arrays 512 and 513 are depicted to be further apart than the linear DRA arrays 521 and 522, one of ordinary skill would recognize that any configuration of the planar DRA arrays 512 and 513 and the linear DRA arrays 521 and 522 can be formed.

The phases corresponding to the DRA elements of the planar DRA arrays 512 and 513 and the linear DRA arrays 521 and 522 can be fixed or variable. Altering the phases corresponding to the DRA elements can move the beam formed by each of the DRA arrays (i.e., each of the planar DRA arrays 512 and 513 and each of the linear DRA arrays 521 and 522) in various directions in space. Additionally, although FIG. 5 illustrates a single metallic ground plane 501, one of ordinary skill would recognize that a separate metallic ground plane may be used for each of the DRA arrays 512, 513, 521, and 522.

Figure 6:
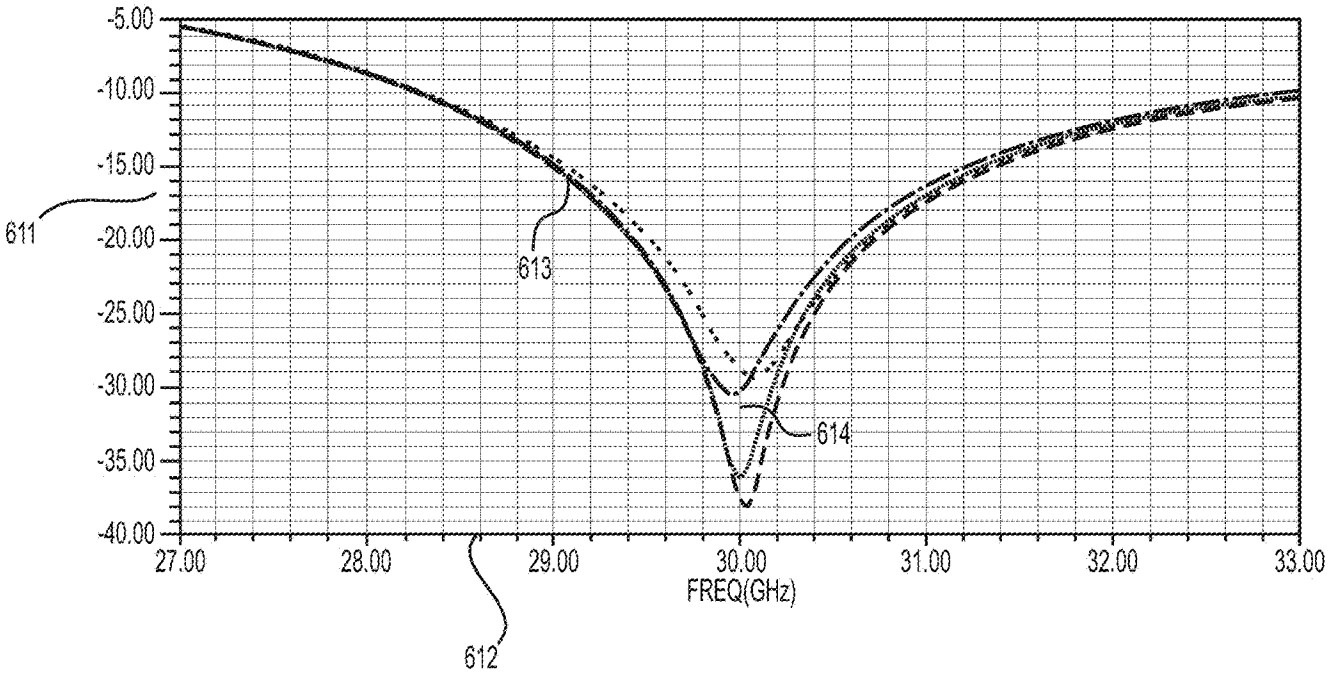
FIG. 6 illustrates s-parameters from a DRA based millimeter-wave based linear array in accordance with exemplary aspects of the present disclosure.

FIG. 6 illustrates exemplary s-parameters from a DRA based millimeter-wave based linear array with one half wavelength inter-element spacing (i.e., 5 mm) and operating at 30 GHz. The reflection coefficient curves 613 for four antenna array elements are illustrated in decibel scale 611, and versus frequency 612. The resonating curves show matching at 30 GHz 614. An increase in coupling due to close element spacing can affect matching.

Figure 7A:
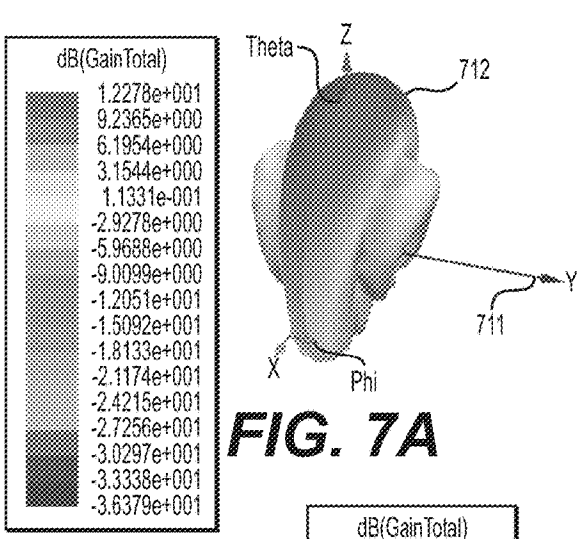
FIGS. 7A-7C illustrate radiation gain patterns of a linear array of DRA elements in accordance with exemplary aspects of the present disclosure.
Figure 7B:
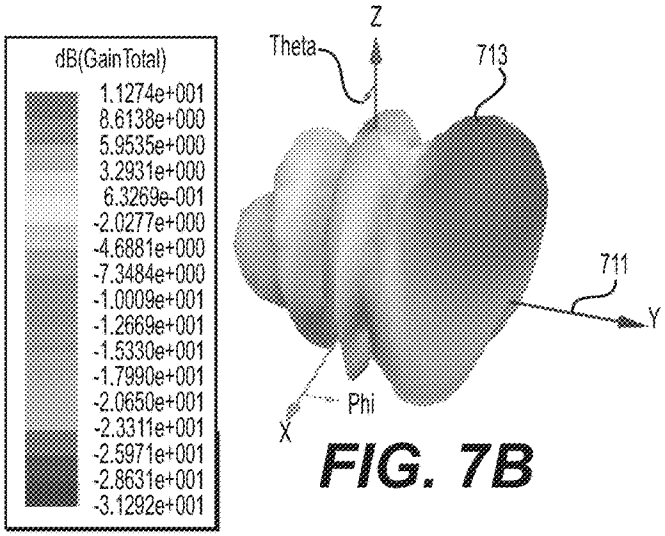
Figure 7C:
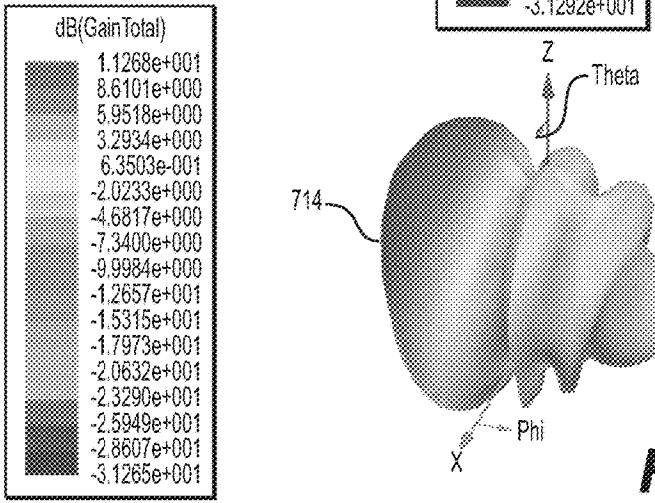

FIGS. 7A-7C illustrate exemplary radiation gain patterns of the linear array of DRA elements with a total of 4 antennas. The 4 antennas can be rectangular, hemispherical, cylindrical, or any other known shape. The three dimensional gain patterns are illustrated in polar coordinates 711. In the first gain pattern 712 illustrated in FIG. 7A, the antenna elements of the linear array have in-phase excitation, or zero angle between inter-elements.

FIG. 7B illustrates another exemplary gain pattern 713 when the linear array of DRA elements point towards 45 degrees in elevation. In such a case a certain progressive phase is applied between the elements in a progressive fashion relative to a previous element in the array. As described above with regard to FIG. 2, a phase control device (not shown) can be used to alter the progressive phases between the DRA elements. Such a phase control device may include circuitry to alter progressive phases between the DRA elements and memory to store values of different progressive phases to be applied to the various DRA elements. Additionally, the memory may also store values corresponding to a fixed beam previously generated by the array of DRA elements and the phase control device can use such data to determine the progressive phases between the DRA elements for future generation of fixed beams. The progressive phases can also be pre-programmed to obtain a fixed beam in a particular direction to allow for MIMO operation and separation of the radiation patterns as illustrated in FIG. 4.

In FIG. 7C, an exemplary three-dimensional gain pattern 714 is formed in the opposite direction compared to that of the three-dimensional gain pattern 713. Here, the gain pattern is tilted by hard coding the progressive phase excitations between adjacent DRA elements within the feed network of the array. Thus, allowing for having two adjacent linear/planar arrays with beams spatially separated allows for good MIMO performance.

Figure 8:
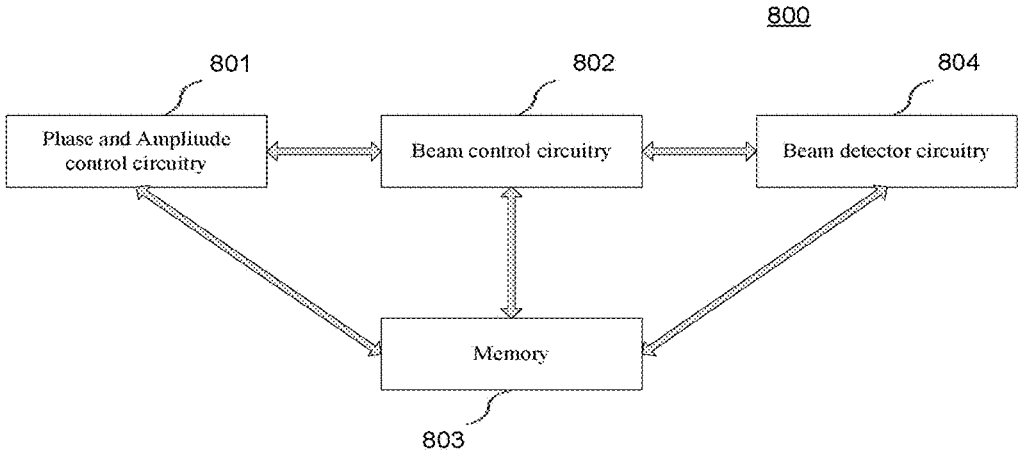
FIG. 8 illustrates control circuitry that controls a direction and shape of a beam formed by a plurality of DRA elements of the plurality of arrays in accordance with exemplary aspects of the present disclosure.

FIG. 8 illustrates exemplary control circuitry 800 to control a direction and shape of a beam formed by a plurality of DRA elements of the plurality of arrays. Such control circuitry 800 or a part of it may be configured to be part of a feed type of microstrip network 22 (illustrated in FIG. 2) or may be separate circuitry connected to the feed type of microstrip network 22 in FIG. 2. The phase and amplitude control circuitry 801 of the control circuitry 800 is configured to detect the current excitation phases of the plurality of DRA elements and alter the excitation phases of the plurality of DRA elements in order to move a beam formed by the plurality of DRA elements in different directions. In addition, the phase and amplitude control circuitry 801 is also configured to detect the amplitude of the signals fed to the plurality of DRA elements and to alter the amplitude of these signals to move a beam formed by the plurality of DRA elements in different directions. The detected excitation phases and the detected amplitudes can be provided to beam control circuitry 802 and memory 803. The shape of the beam can also be altered by altering the phase and amplitude.

FIG. 8 further illustrates beam detector circuitry 804 that is configured to detect direction, shape, and strength of the beams produced by the plurality of DRA elements of a plurality of arrays. The beam detector circuitry 804 is configured to provide such information to the beam control circuitry 802 and memory 803. Since a plurality of arrays may be formed and a plurality of beams may be generated by the plurality of arrays of DRA elements, the beam detector circuitry 804 is configured to detect shapes, directions, and strength of the beams produced by the plurality of arrays of DRA elements and report the findings to the beam control circuitry 802 and/or memory 803.

The beam control circuitry 802 is configured to provide signals to the phase and amplitude control circuitry 801 so that the phase and amplitude control circuitry 801 can alter the excitation phases (or the amplitude) of the plurality of DRA elements accordingly. The beam control circuitry 802 is capable of providing signals to the phase and amplitude control circuitry 801 to allow the plurality of DRA elements to produce a wide variety of beam shapes in various different directions. In addition to being connected to the phase and amplitude control circuitry 801, the beam control circuitry 802 is also connected to the memory 803 and beam detector circuitry 804.

Memory 803 may include data regarding beam shapes and directions and corresponding phases and amplitudes required to generate a corresponding beam shape and direction. For example, memory may store previously detected beams shapes and directions of the beams (such information being provided from beam detector circuitry 804) and corresponding detected phases and amplitudes (such information being provided from the phase and amplitude control circuitry 801). When such information is received by memory 803 from the beam detector circuitry 804 and the phase and amplitude control circuitry 801, memory 803 may save such information in a table format.

When beam control circuitry 802 receives information from the beam detector circuitry 804 and the phase and amplitude control circuitry 801, the beam control circuitry 802 may perform various actions. If the beam control circuitry 802 notices an overlap between the beams detected by the beam detector circuitry 804, the beam control circuitry 802 may request memory 803 to send information regarding excitation phases corresponding to the plurality of DRA elements of the plurality of arrays and may instruct the phase and amplitude control circuitry 801 to alter the excitations phases of some (or all) of the plurality of DRA elements of the plurality of arrays so that the beams generated by the plurality of arrays do not overlap and are pointing in different directions. However, even if the information received from the beam detector circuitry 804 does not indicate an overlap between various beams, the beam control circuitry 802 may still request the memory 803 for information regarding excitations phases corresponding to the plurality of DRA elements, and provide information regarding the excitation phases corresponding to the plurality of DRA elements of the plurality of arrays to the phase and amplitude control circuitry 801 so as to tilt one or a plurality of beams such that the overall strength of all the beams produced by the plurality of arrays of DRA elements is the strongest.

The memory 803 may also store a plurality of program instructions that include instructions for the beam control circuitry 802 to instruct the phase and amplitude circuitry 801 to alter the excitations phases of the plurality of DRA elements of the plurality of arrays so as to tilt the beams (generated by the plurality of DRA elements of the plurality of arrays) in various different directions in real space. The shapes of the beams may also be altered in addition to altering the direction of the beams. The plurality of program instructions stored in memory 803 or in any other computer-readable storage medium may include instructions for the steps described below with regard to FIG. 9. The phase and amplitude control circuitry 801, the beam control circuitry 802, the beam detector circuitry 804, and the memory 803 may be connected via wires or wirelessly.

Figure 9:
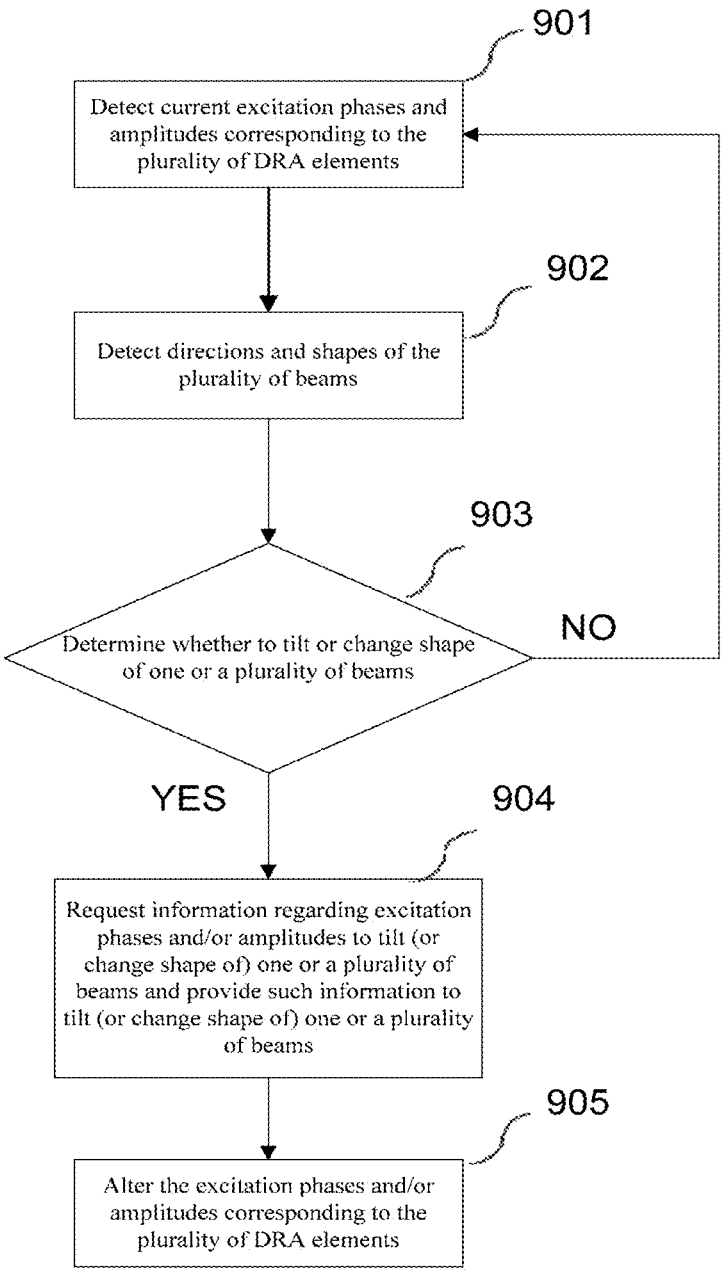
FIG. 9 illustrates an exemplary method to alter the phase of a plurality of DRA elements in accordance with exemplary aspects of the present disclosure.

FIG. 9 illustrates an exemplary method to alter the phase of a plurality of DRA elements of a plurality of arrays. In Step 901, the phase and amplitude control circuitry 801 detects the current excitation phases and amplitudes corresponding to the plurality of DRA elements of the plurality of arrays and reports the detected findings to the beam control circuitry 802. In Step 902, the beam detector circuitry 804 detects directions and shapes of the beams and reports the findings to the beam control circuitry 802. Although Step 901 is illustrated before Step 902, one of ordinary skill would recognize that Step 902 may be performed prior to Step 901.

In Step 903, the beam control circuitry 802 determines, based on the received excitation phases and amplitudes corresponding to the plurality of DRA elements of the plurality of arrays and the received directions and shapes of the beams, whether to tilt a beam or a plurality of beams (or to change the shape of the beam or the plurality of beams). Further, in Step 903, the beam control circuitry 802 may also receive instructions from the program instructions stored in memory 803. The program instructions may instruct the beam control circuitry 802 to tilt a beam or a plurality of beams based on the received excitation phases and amplitudes corresponding to the plurality of DRA elements of the plurality of arrays and the received directions and shapes of the beams. The program instructions may also instruct the beam control circuitry 802 to tilt a beam or a plurality of beams based on at least one of a location information of the plurality of DRA elements of the plurality of arrays, a detected location of an object that communicates with the plurality of DRA elements of the plurality of arrays, or the detected strength of the plurality of beams.

If a determination is made not to tilt the beam or the plurality of beams, then the process ends or goes back to Step 901. If, however, a determination is made to tilt a beam of a plurality of beams (or to change the shape of the beam/beams), the beam control circuitry 802 requests information from the memory 803 regarding excitation phases and/or amplitudes to tilt one or a plurality of beams and instructs the phase and amplitude control circuitry 801 to alter the excitation phase (or amplitude) corresponding to the plurality of DRA elements of the plurality of arrays in Step 904.

In Step 905, the phase and amplitude control circuitry 801 is configured to alter the excitation phases (or amplitudes) of one or a plurality of DRA elements of a plurality of arrays such that a beam or a plurality of beams are tilted in a different direction (or such that a shape of a beam or a plurality of beams are changed). Although the above description describes a plurality of arrays and a plurality of beams, it should be understood that the present invention can be modified so that only one beam is formed by a plurality of DRA elements of a single array. The program instructions stored in memory 903 may include instructions corresponding to all the steps described above.

Figure 10:
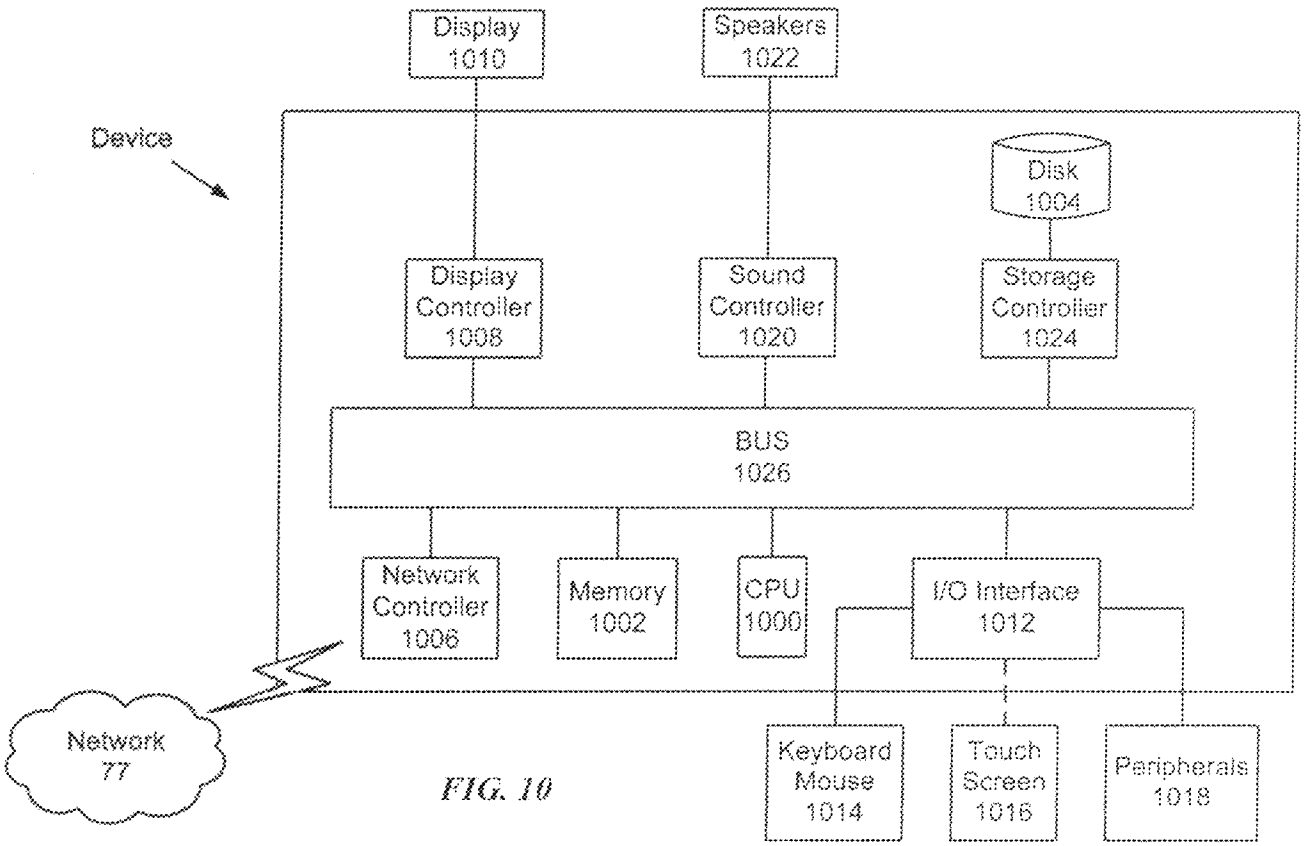
FIG. 10 is a block diagram of an exemplary computer system in accordance with exemplary aspects of the present disclosure.

Next, a hardware description of a device according to exemplary implementations is described with reference to FIG. 10. The structure of the device illustrated in FIG. 10 is exemplary of phones, laptops, tablets, or another device including a computer as mentioned herein. Although the specific description provided below regarding FIG. 10 specifically pertains to phones, laptops, or tablets, it should be appreciated that corresponding structures or components can be provided in other devices discussed herein, and not all of the components or connections illustrated in FIG. 10 may be provided in particular devices.

In FIG. 10, the device includes a CPU 1000 which performs, or executes, the processes and algorithms described herein. Process data and instructions may be stored in memory 1002. Processes and instructions may also be stored on a storage medium disk 1004 such as a hard drive (HDD) or portable storage medium or may be stored remotely. Further, executable instructions are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the device communicates, such as a server or computer.

Further, executable instructions may be provided as a utility application, background daemon, or component of an operating system, or combination thereof, executing in conjunction with CPU 1000 and an operating system such as Android, iOS, Windows Mobile, Windows Phone, Microsoft Windows 7 or 8, UNIX, Solaris, LINUX, Apple MAC-OS and other operating systems.

CPU 1000 may be a Xenon or Core processor from Intel of America or an Opteron processor from AMD of America, especially in implementations where the device is a computer or a server. Other processors can be utilized when the device is, e.g., a mobile phone, a smartphone, a tablet, a battery-operated device, or a portable computing device. For example, a Qualcomm Snapdragon or ARM-based processor can be utilized. The CPU 1000 may be implemented on an FPGA, ASIC, PLD or using discrete logic circuits, as one of ordinary skill in the art would recognize. Further, CPU 1000 may be implemented as multiple processors cooperatively working in parallel to perform the instructions of the processes described above, and the CPU 1000 may incorporate processing circuitry other than generic processing circuitry, whereby the CPU 1000 includes circuitry to execute specific display and user interface controls that may otherwise be provided for by other discrete circuitry.

The device in FIG. 10 also includes a network controller 1006, such as an Intel Ethernet PRO network interface card from Intel Corporation of America, for interfacing with network 77 when the device is a computer or a server, for example. This network connection can be via the antenna array proposed above for various wireless standards. Millimeter-wave DRA arrays will be widely used for 5G wireless standards as part of this network interface. When the device is a portable electronic device, the network controller 1006 includes a radio that may be incorporated into the CPU 1000. The radio may incorporate various wireless communication technologies as separate circuits or shared circuitry, and the technologies can incorporate LTE, GSM, CDMA, WiFi, Bluetooth, NFC, infrared, FM radio, AM radio, ultrasonic, and/or RFID circuitry. The network 77 can be a public network, such as the Internet, or a private network such as a LAN or WAN network, or any combination thereof and can also include PSTN or ISDN sub-networks. The network 77 can also be wired, such as an Ethernet network, or can be wireless such as a cellular network including EDGE, 3G and 4G wireless cellular systems. The network 77 may be connected to a server to allow the device to download and install application software to implement aspects of this disclosure. The wireless network can also be WiFi, Bluetooth, or any other wireless form of communication. In the exemplary implementations discussed herein, the network 77 can include both the Internet and a Bluetooth communication channel, but this is not limiting as other combinations are applicable when a different short-range communication technology is utilized.

The device further includes, when the device is a computer or a server, a display controller 1008, such as a NVIDIA GeForce GTX or Quadro graphics adaptor from NVIDIA Corporation of America for interfacing with display 1010, such as a Hewlett Packard HPL2445w LCD monitor. A general purpose I/O interface 1012 interfaces with a keyboard and/or mouse 1014 as well as a touch screen panel 1016 on or separate from display 1010. General purpose I/O interface also connects to a variety of peripherals 1018 including printers and scanners. When the device is, e.g., a smartphone, the display 1010 can be integrated into the device and can be a touchscreen display. Further, the display controller 1008 can be incorporated into the CPU 1000.

A sound controller 1020 is also provided in the device, such as Sound Blaster X-Fi Titanium from Creative, to interface with speakers/microphone 1022 thereby providing sounds and/or music. The sound controller 1020 can also be incorporated into the CPU 1000 when the device is, e.g., a smartphone.

The general purpose storage controller 1024 connects the storage medium disk 1004 with communication bus 1026, which may be an ISA, EISA, VESA, PCI, or similar, for interconnecting all or some of the components of the device. A description of the general features and functionality of the display 1010, keyboard and/or mouse 1014, as well as the display controller 1008, storage controller 1024, network controller 1006, sound controller 1020, and general purpose I/O interface 1012 is omitted herein for brevity.

Although the description and discussion were in reference to certain exemplary embodiments of the present disclosure, numerous additions, modifications and variations will be readily apparent to those skilled in the art. The scope of the invention is given by the following claims, rather than the preceding description, and all additions, modifications, variations and equivalents that fall within the range of the stated claims are intended to be embraced therein.

Thus, the foregoing discussion discloses and describes merely exemplary implementations. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

Exemplary Implementations

A. A dielectric resonator antenna array system, comprising:

a first array of a plurality of dielectric resonator antennas arranged in a first orientation and configured to form a first beam; and a second array of a plurality of dielectric resonator antennas arranged in a second orientation, different from the first orientation, and configured to form a second beam.

B. The dielectric resonator antenna array system according to A, further comprising:

a first feed network configured to provide a first signal to the first array of the plurality of dielectric resonator antennas; and a second feed network configured to provide a second signal to the second array of the plurality of dielectric resonator antennas.

C. The dielectric resonator antenna array system according to any of A to B, wherein the first feed network includes a first port and the second feed network includes a second port.

D. The dielectric resonator antenna array system according to any of A to C, wherein the first array of the plurality of dielectric resonator antennas and the second array of the plurality of dielectric resonator antennas include at least one of a hemispherical antenna, a cylindrical antenna, a circular cross-section antenna, or a rectangular antenna.

E. The dielectric resonator antenna array system according any of A to D, wherein the first feed network and the second feed network include a first plurality of branches and a second plurality of branches, respectively, connected to respective plurality of dielectric resonator antennas, and the first plurality of branches and the second plurality of branches provide phase distribution between the respective plurality of dielectric resonator antennas.

F. The dielectric resonator antenna array system according to any of A to E, wherein a direction of at least one of the first beam or the second beam in space is changed based on a change in the phase distribution between the respective plurality of dielectric resonator antennas.

G. The dielectric resonator antenna array system according to any of A to F, wherein the first plurality of branches and the second plurality of branches provide amplitude distribution between the respective plurality of dielectric resonator antennas.

H. The dielectric resonator antenna array system according to any of A to G, wherein a direction of at least one of the first beam or the second beam in space is changed based on a change in the amplitude distribution between the respective plurality of dielectric resonator antennas.

I. The dielectric resonator antenna array system according to any of A to H, wherein the first orientation corresponds to a planar orientation and the second orientation corresponds to a linear orientation.

J. The dielectric resonator antenna array system according to any of A to I, wherein the first feed network includes a first plurality of branches that splits the first signal prior to being provided to the first array of the plurality of dielectric resonator antennas.

K. The dielectric resonator antenna array system according to any of A to J, wherein the second feed network includes a second plurality of branches that splits the second signal prior to being provided to the second array of the plurality of dielectric resonator antennas.

L. The dielectric resonator antenna array system according to any of A to K, wherein the first array of the plurality of dielectric resonator antennas corresponds to a first type of dielectric resonator antennas, and the second array of the plurality of dielectric resonator antennas corresponds to a second type of dielectric resonator antennas.

M. The dielectric resonator antenna array system according to any of A to L, wherein the first array of the plurality of dielectric resonator antennas and the second array of the plurality of dielectric resonator antennas correspond to a same type of dielectric resonator antennas.

N. The dielectric resonator antenna array system according to any of A to M, further comprising circuitry configured to:

detect current excitation phases corresponding to the first array of the plurality of dielectric resonator antennas and the second array of the plurality of dielectric resonator antennas; and detect a first direction and a first shape of the first beam, and detect a second direction and a second shape of the second beam.

O. The dielectric resonator antenna array system according to any of A to N, wherein the circuitry is configured to:

determine whether to change at least one of the first direction or the first shape of the first beam;

determine whether to change at least one of the second direction or the second shape of the second beam;

retrieve data of new excitation phases corresponding to the first array of the plurality of dielectric resonator antennas when a determination is made to change at least one of the first direction or the first shape of the first beam; and retrieve data of other new excitation phases corresponding to the second array of the plurality of dielectric resonator antennas when a determination is made to change at least one of the second direction or the second shape of the second beam.

P. The dielectric resonator antenna array system according to any of A to O, wherein the circuitry is configured to:

alter the current excitation phases corresponding to the first array of the plurality of dielectric resonator antennas and the second array of the plurality of dielectric resonator antennas with at least one of the new excitation phases or the other new excitation phases.

Q. The dielectric resonator antenna array system according to any of A to P, wherein said circuitry is configured to determine whether to change at least one of the first direction or the first shape of the first beam, and to determine whether to change at least one of the second direction or the second shape of the second beam based on the detected current excitation phases corresponding to the first array of the plurality of dielectric resonator antennas and the second array of the plurality of dielectric resonator antennas.

R. The dielectric resonator antenna array system according to any of A to Q, wherein said circuitry is configured to determine whether to change at least one of the first direction or the first shape of the first beam, and to determine whether to change at least one of the second direction or the second shape of the second beam based on a location of an object communicating with the dielectric resonator antenna system.

S. A dielectric resonator antenna array system, comprising:

a first array of a first type of plurality of dielectric resonator antennas arranged in a predetermined orientation and configured to form a first beam; and a second array of a second type of plurality of dielectric resonator antennas arranged in the predetermined orientation and configured to form a second beam.

T. A dielectric resonator antenna array system, comprising:

a first array of a plurality of dielectric resonator antennas arranged in a first orientation and configured to form a first beam;

a second array of a plurality of dielectric resonator antennas arranged in a second orientation, different from the first orientation, and configured to form a second beam;

a first feed network configured to provide a first signal to the first array of the plurality of dielectric resonator antennas to form the first beam; and a second feed network configured to provide a second signal to the second array of the plurality of dielectric resonator antennas to form the second beam.

The invention claimed is:

1. A dielectric resonator antenna array system, comprising:

a first array of a plurality of dielectric resonator antennas arranged in a first orientation and configured to form a first beam;

a second array of a plurality of dielectric resonator antennas arranged in a second orientation, different from the first orientation, and configured to form a second beam; and circuitry configured to receive detected beam shapes and corresponding excitation phases and amplitudes, store an association between the detected beam shapes and the corresponding excitation phases and amplitudes in a look-up table, and retrieve from the look-up table information associated with the excitation phases in response to determining that one or more beams overlaps.

2. The dielectric resonator antenna array system according to claim 1, further comprising:

a first feed network configured to provide a first signal to the first array of the plurality of dielectric resonator antennas; and a second feed network configured to provide a second signal to the second array of the plurality of dielectric resonator antennas.

3. The dielectric resonator antenna array system according to claim 2, wherein the first feed network includes a first port and the second feed network includes a second port.

4. The dielectric resonator antenna array system according to claim 1, wherein the first array of the plurality of dielectric resonator antennas and the second array of the plurality of dielectric resonator antennas include at least one of a hemispherical antenna, a cylindrical antenna, a circular cross-section antenna, or a rectangular antenna.

5. The dielectric resonator antenna array system according to claim 2, wherein the first feed network and the second teed network include a first plurality of branches and a second plurality of branches, respectively, connected to respective plurality of dielectric resonator antennas, and the first plurality of branches and the second plurality of branches provide phase distribution between the respective plurality of dielectric resonator antennas.

6. The dielectric resonator antenna array system according to claim 5, wherein a direction of at least one of the first beam or the second beam in space is changed based on a change in the phase distribution between the respective plurality of dielectric resonator antennas.

7. The dielectric resonator antenna array system according to claim 5, wherein the first plurality of branches and the second plurality of branches provide amplitude distribution between the respective plurality of dielectric resonator antennas.

8. The dielectric resonator antenna array system according to claim 7, wherein a direction of at least one of the first beam or the second beam in space is changed based on a change in the amplitude distribution between the respective plurality of dielectric resonator antennas.

9. The dielectric resonator antenna array system according to claim 1, wherein the first orientation corresponds to a planar orientation and the second orientation corresponds to a linear orientation.

10. The dielectric resonator antenna array system according to claim 2, wherein the first feed network includes a first plurality of branches that splits the first signal prior to being provided to the first array of the plurality of dielectric resonator antennas.

11. The dielectric resonator antenna array system according to claim 2, wherein the second feed network includes a second plurality of branches that splits the second signal prior to being provided to the second array of the plurality of dielectric resonator antennas.

12. The dielectric resonator antenna array system according to claim 1, wherein the first array of the plurality of dielectric resonator antennas corresponds to a first type of dielectric resonator antennas, and the second array of the plurality of dielectric resonator antennas corresponds to a. second type of dielectric resonator antennas.

13. The dielectric resonator antenna array system according to claim 1, wherein the first array of the plurality of dielectric resonator antennas and the second array of the plurality of dielectric resonator antennas correspond to a same type of dielectric resonator antennas.

14. The dielectric resonator antenna array system according to claim 1, wherein the circuitry is configured to:

determine whether to change at least one of a first direction or a first shape of the first beam;

determine whether to change at least one of a second direction or a second shape of the second beam;

retrieve data of new excitation phases corresponding to the first array of the plurality of dielectric resonator antennas when a determination is made to change at least one of the first direction or the first shape of the first beam; and retrieve data of other new excitation phases corresponding to the second array of the plurality of dielectric resonator antennas when a determination is made to change at least one of the second direction or the second shape of the second beam.

15. The dielectric resonator antenna array system according to claim 14, wherein the circuitry is configured to:

alter the current excitation phases corresponding to the first array of the plurality of dielectric resonator antennas and the second array of the plurality of dielectric resonator antennas with at least one of the new excitation phases or the other new excitation phases.

16. The dielectric resonator antenna array system according to claim 14, wherein said circuitry is configured to determine whether to change at least one of the first direction or the first shape of the first beam, and to determine whether to change at least one of the second direction or the second shape of the second beam based on the detected current excitation phases corresponding to the first array of the plurality of dielectric resonator antennas and the second array of the plurality of dielectric resonator antennas.

17. The dielectric resonator antenna array system according to claim 14, wherein said circuitry is configured to determine whether to change at least one of the first direction or the first shape of the first beam, and to determine whether to change at least one of the second direction or the second shape of the second beam based on a location of an object communicating with the dielectric resonator antenna system.

* * * * *